US007642997B2

(12) United States Patent
Hamer et al.

(10) Patent No.: US 7,642,997 B2
(45) Date of Patent: Jan. 5, 2010

(54) ACTIVE MATRIX DISPLAY COMPENSATION

(75) Inventors: John W. Hamer, Rochester, NY (US); Gary Parrett, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 557 days.

(21) Appl. No.: 11/427,139

(22) Filed: Jun. 28, 2006

(65) Prior Publication Data

US 2008/0001855 A1 Jan. 3, 2008

(51) Int. Cl.
*G09G 3/30* (2006.01)

(52) U.S. Cl. ..... 345/76; 345/82

(58) Field of Classification Search ..... 345/76–84, 345/6

See application file for complete search history.

(56) References Cited

U.S. PATENT DOCUMENTS

| | | | | |
|---|---|---|---|---|
| 7,071,932 | B2 * | 7/2006 | Libsch et al. | 345/211 |
| 7,106,006 | B2 * | 9/2006 | Koyama | 315/169.3 |
| 7,119,768 | B2 * | 10/2006 | Yazawa et al. | 345/76 |
| 7,148,629 | B2 * | 12/2006 | Ha et al. | 315/169.3 |
| 7,199,768 | B2 * | 4/2007 | Ono et al. | 345/76 |
| 2001/0024186 | A1 * | 9/2001 | Kane et al. | 345/98 |
| 2005/0264493 | A1 * | 12/2005 | Shin | 345/76 |
| 2006/0284801 | A1 * | 12/2006 | Yoon et al. | 345/76 |
| 2007/0030217 | A1 * | 2/2007 | Peng | 345/76 |
| 2007/0030219 | A1 * | 2/2007 | Park et al. | 345/76 |

FOREIGN PATENT DOCUMENTS

| | | |
|---|---|---|
| WO | WO2004/097782 | 11/2004 |
| WO | WO2005/069267 | 7/2005 |

OTHER PUBLICATIONS

J.H. Jung et al.; Development of a 14.1 Inch Full Color AMOLED Display with Top Emission Structure; IMID '05 Digest; pp. 793-796.
Joon-Chul Goh et al.; A New a-Si:H Thin-Film Transitor Pixel Circuit for Active-Matrix Organic Light-Emitting Diodes; IEEE Electron Device Letters, vol. 24, No. 9, Sep. 2003.

* cited by examiner

*Primary Examiner*—Alexander Eisen
*Assistant Examiner*—Nelson Lam
(74) *Attorney, Agent, or Firm*—Raymond L. Owens

(57) ABSTRACT

An apparatus for selecting a stressing voltage for compensating for changes in the threshold voltages ($V_{th}$) for drive transistors in pixel drive circuits in an active matrix OLED display having a plurality of OLED light-emitting pixels arranged in an array is disclosed.

10 Claims, 8 Drawing Sheets

ACTIVE MATRIX DISPLAY COMPENSATION

CROSS REFERENCE TO RELATED APPLICATIONS

The present application is related to U.S. Ser. No. 11/427,104 (Publication No. 2008/0001854, filed concurrently herewith, of John W. Hamer and Gary Parrett, entitled "Active Matrix Display Compensation".

FIELD OF THE INVENTION

The present invention relates to an active matrix-type display apparatus for driving display elements.

BACKGROUND OF THE INVENTION

In recent years, it has become necessary that image display devices have high-resolution and high picture quality, and it is desirable for such image display devices to have low power consumption and be thin, lightweight, and visible from wide angles. With such requirements, display devices (displays) have been developed where thin-film active elements (thin-film transistors, also referred to as TFTs) are formed on a glass substrate, with display elements then being formed on top.

In general, a substrate forming active elements is such that patterning and interconnects formed using metal are provided after forming a semiconductor film of amorphous silicon or polysilicon etc. Due to differences in the electrical characteristics of the active elements, the former requires ICs (Integrated Circuits) for drive use, and the latter is capable of forming circuits for drive use on the substrate. In liquid crystal displays (LCDs) currently widely used, the amorphous silicon type is widespread for large-type screens, while the polysilicon type is more common in medium and small screens.

Typically, organic EL elements are used in combination with TFTs and utilize a voltage/current control operation so that current is controlled. The current/voltage control operation refers to the operation of applying a signal voltage to a TFT gate terminal so as to control current between the source and drain. As a result, it is possible to adjust the intensity of light emitted from the organic EL element and to control the display to the desired gradation.

However, in this configuration, the intensity of light emitted by the organic EL element is extremely sensitive to the TFT characteristics. In particular, for amorphous silicon TFTs (referred to as a-Si), it is known that comparatively large differences in electrical characteristics occur with time between neighboring pixels, due to changes in transistor threshold voltage. This is a major cause of deterioration of the display quality of organic EL displays, in particular, screen uniformity. Uncompensated, this effect can lead to "burned-in" images on the screen.

Goh et al. (IEEE Electron Device Letters, Vol. 24, No. 9, pp. 583-585) have proposed a pixel circuit with a precharge cycle before data loading, to compensate for this effect. Compared to the standard OLED pixel circuit with a capacitor, a select transistor, a power transistor, and power, data, and select lines, Goh's circuit uses an additional control line and two additional switching transistors. Jung et al. (IMID '05 Digest, pp. 793-796) have proposed a similar circuit with an additional control line, an additional capacitor, and three additional transistors. While such circuits can be used to compensate for changes in the threshold voltage of the driving transistor, they add to the complexity of the display, thereby increasing the cost and the likelihood of defects in the manufactured product. Further, such circuitry generally comprises thin-film transistors (TFTs) and necessarily uses up a portion of the substrate area of the display. For bottom-emitting devices, the aperture ratio is important, and such additional circuitry reduces the aperture ratio, and can even make such bottom-emitting displays unusable. Thus, there exists a need to compensate for changes in the electrical characteristics of the pixel circuitry in an OLED display without reducing the aperture ratio of such a display.

SUMMARY OF THE INVENTION

It is therefore an object of the present invention to provide an apparatus and method of compensating for changes in the electrical characteristics of the pixel circuitry in an OLED display.

This object is achieved by an apparatus for selecting a stressing voltage for compensating for changes in the threshold voltages ($V_{th}$) for drive transistors in pixel drive circuits in an active matrix OLED display having a plurality of OLED light-emitting pixels arranged in an array, comprising:

a) each pixel drive circuit being electrically connected to a data line and a power supply line, and having a drive transistor having source, drain, and gate electrodes, and a switch transistor having source, drain, and gate electrodes;

b) the source or drain electrode of each drive transistor being electrically connected to its corresponding power supply line, and the other of the source or drain electrode being electrically connected to its corresponding OLED light-emitting pixel;

c) the source or the drain electrode of each switch transistor being electrically connected to the gate electrode of its corresponding drive transistor, and the other of the source or drain electrode being electrically connected to its corresponding data line;

d) first means for applying a first voltage to the power supply lines which is either positive or negative for causing current to flow in a first direction through the drive transistors which causes the OLED light-emitting pixels to produce light in response to the signal voltages;

e) second means for applying a second voltage to the power supply lines opposite in polarity to the first voltage so that current will flow through the drive transistors in a second direction opposite to the first direction until the potential on the gate electrodes of the drive transistors causes the drive transistors to turn off;

f) third means for producing a plurality of threshold-voltage-related signals on the data lines, each of which is a function of the corresponding potentials on the gate electrodes of the drive transistors;

g) fourth means responsive to the plurality of threshold-voltage-related signals for producing an average threshold-voltage-related signal; and h) fifth means responsive to the threshold-voltage-related signals for selecting the stressing voltage.

ADVANTAGES

It is an advantage of the present invention that it can compensate for changes in the electrical characteristics of the thin-film transistors of an OLED display. It is a further advantage of this invention that it can so compensate without reducing the aperture ratio of a bottom-emitting OLED display and without increasing the complexity of the within-pixel circuits. It is a further advantage of this invention that it reduces the power requirements of an OLED display and allows the apparatus generating the signal voltages to be designed for a smaller voltage range.

DETAILED DESCRIPTION OF THE INVENTION

Figure 1:
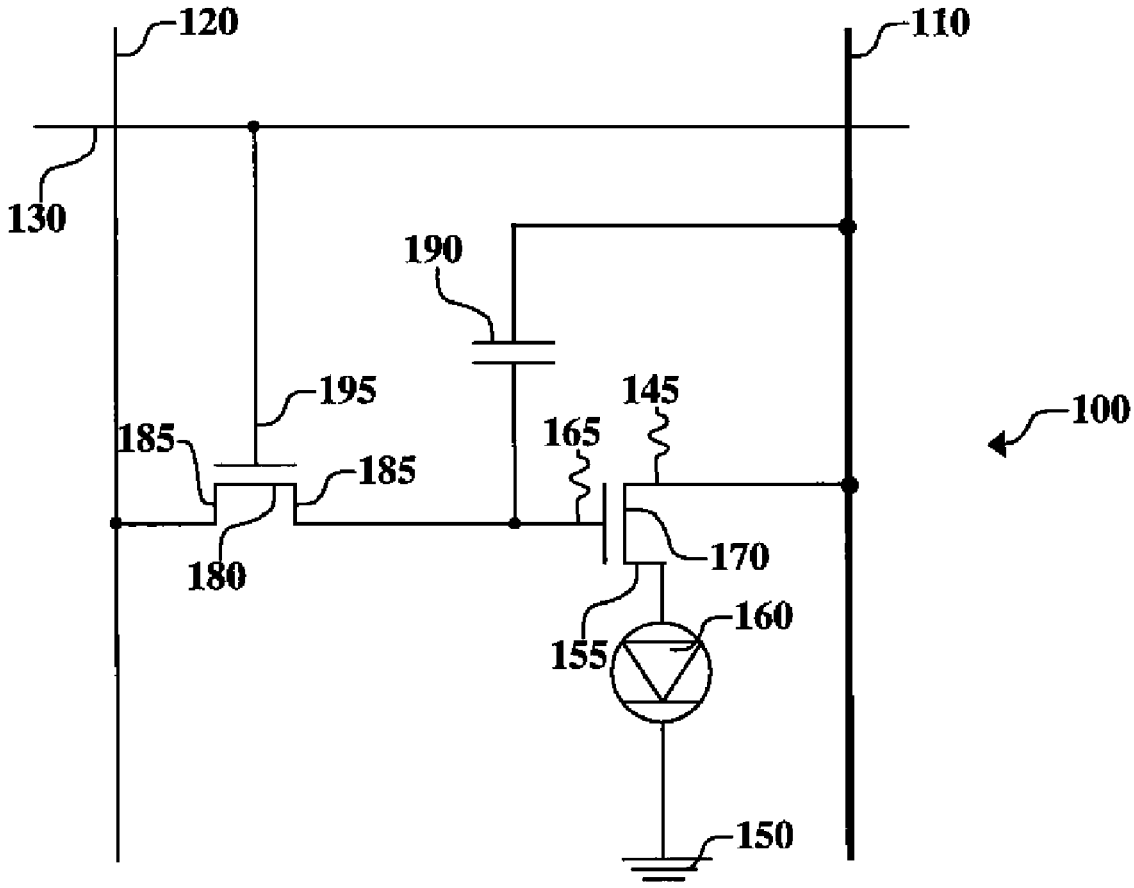
FIG. 1 shows a schematic diagram of an OLED pixel drive circuit well-known in the art.

Turning now to FIG. 1, there is shown a schematic diagram of one embodiment of an OLED pixel drive circuit that can be used in this invention. Such pixel drive circuits are well known in the art in active matrix OLED displays. OLED pixel drive circuit 100 has a data line 120, a power supply line 110, a select line 130, a drive transistor 170, a switch transistor 180, an OLED light-emitting pixel 160, and a capacitor 190. Drive transistor 170 has drain electrode 145, source electrode 155, and gate electrode 165. In pixel drive circuit 100, drain electrode 145 of drive transistor 170 is electrically connected to power supply line 110, while source electrode 155 is electrically connected to OLED light-emitting pixel 160. By electrically connected, it is meant that the elements are directly connected or connected via another component, e.g. a switch, a diode, another transistor, etc. It will be understood that embodiments are possible wherein the source and drain electrode connections are reversed. OLED light-emitting pixel 160 is a non-inverted OLED pixel, wherein the anode of the pixel is electrically connected to power line 110 and the cathode of the pixel is electrically connected to ground 150. Switch transistor 180 has gate electrode 195, as well as source and drain electrodes, together represented as source or drain electrodes 185 because such transistors are commonly bidirectional. Of the source and drain electrodes 185 of switch transistor 180, one is electrically connected to the gate electrode 165 of drive transistor 170, while the other is electrically connected to data line 120. Gate electrode 195 is electrically connected to select line 130. OLED light-emitting pixel 160 is powered by flow of current between power supply line 110 and ground 150. In this embodiment, power supply line 110 has a positive potential, relative to ground 150, for driving OLED light-emitting pixel 160. The normal driving potential will herein be referred to as the first voltage and is positive for this embodiment. It will cause current to flow through drive transistor 170 and OLED light-emitting pixel 160 in a first direction, that is, electrons will flow from ground 150 to power line 110, which will cause OLED light-emitting pixel 160 to produce light. The magnitude of the current—and therefore the intensity of the emitted light—is controlled by drive transistor 170, and more exactly by the magnitude of the signal voltage on gate electrode 165 of drive transistor 170. During a write cycle, select line 130 activates switch transistor 180 for writing and the signal voltage data on data line 120 is written to drive transistor 170 and stored on capacitor 190, which is connected between gate electrode 165 and power supply line 110.

Figure 2:
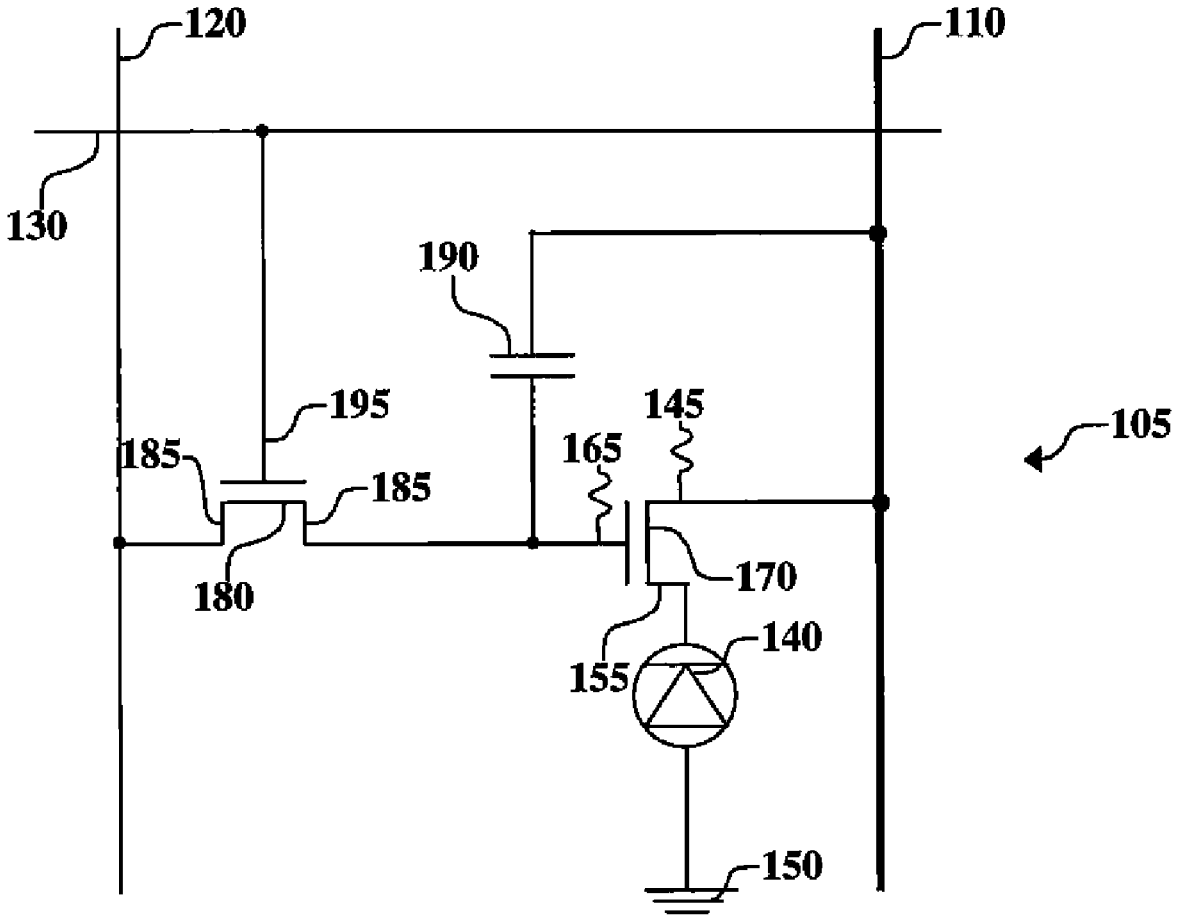
FIG. 2 shows a schematic diagram of one embodiment of a common OLED pixel drive circuit that is useful in this invention.

Turning now to FIG. 2, there is shown a schematic diagram of another embodiment of an OLED pixel drive circuit that can be used in this invention. Pixel drive circuit 105 is constructed much as pixel drive circuit 100 described above. However, OLED light-emitting pixel 140 is an inverted OLED pixel, wherein the cathode of the pixel is electrically connected to power line 110 and the anode of the pixel is electrically connected to ground 150. In this embodiment, power supply line 110 must have a negative potential, relative to ground 150, for driving OLED light-emitting pixel 160. Therefore, the first voltage is negative relative to ground 150 for this embodiment and the first direction in which current flows so as to drive OLED light-emitting pixel 140 will be the reverse of that in FIG. 1. It will be understood in the examples to follow that one can reverse the potentials and current directions if necessary for the structure and function of the OLED pixel drive circuits, and that such modifications are within the scope of this invention.

The above embodiments are constructed wherein the drive transistors and switch transistors are n-channel transistors. It will be understood by those skilled in the art that embodiments wherein the drive transistors and switch transistors are p-channel transistors, with appropriate well-known modifications to the circuits, can also be useful in this invention.

Figure 3:
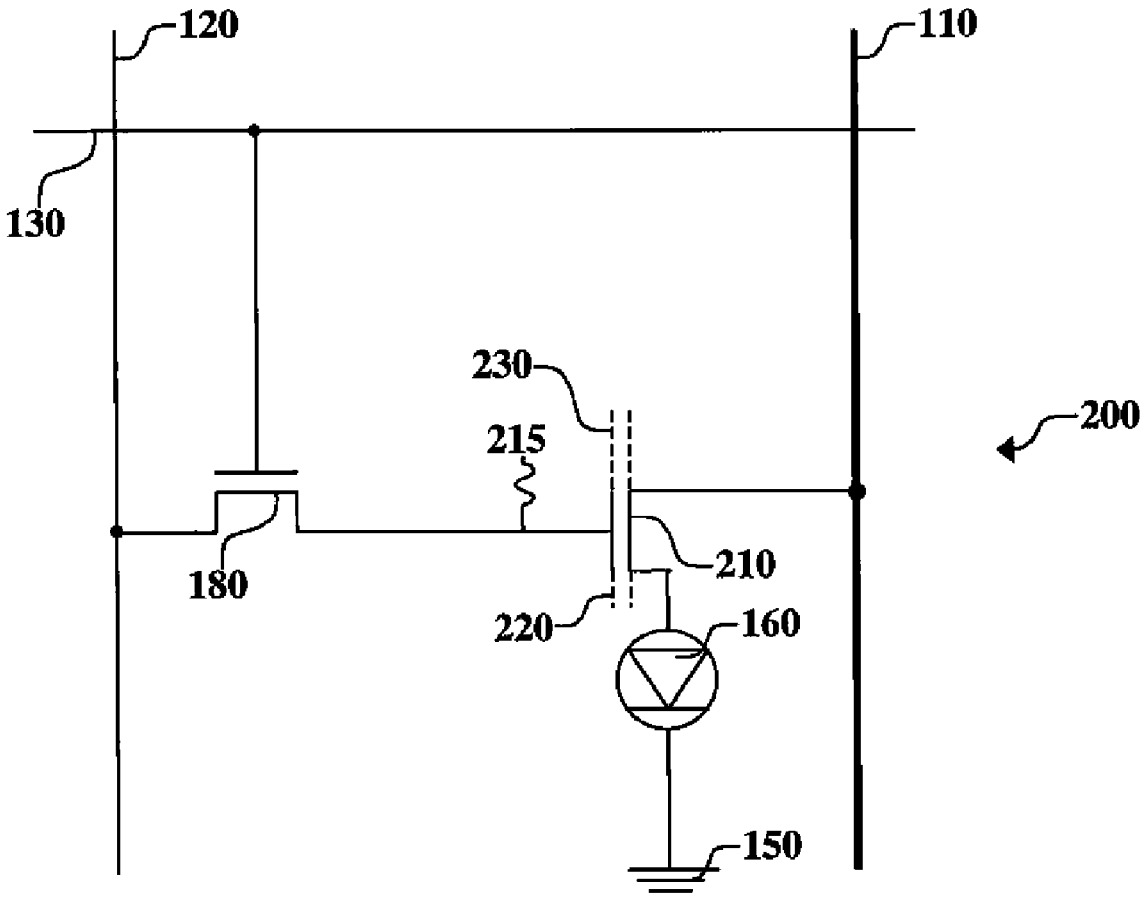
FIG. 3 shows a schematic diagram of another embodiment of a common OLED pixel drive circuit that is useful in this invention.

In practice in active-matrix displays, the capacitance is often not provided as a separate entity, but in a portion of the thin-film transistor sections that form the drive transistor. FIG. 3 shows a schematic diagram of one embodiment of a common OLED pixel drive circuit 200 of this type, which is useful in this invention. Drive transistor 210 also incorporates a capacitor 230 connected between gate electrode 215 and power line 110. This will also be referred to as the gate-power capacitor, or $C_{gp}$. Drive transistor 210 generally inherently includes a smaller parasitic capacitor 230 connected between gate electrode 215 and OLED light-emitting pixel 160. This will also be referred to as the gate-OLED capacitor, or $C_{go}$. In some embodiments, the relative magnitude of $C_{gp}$ and $C_{go}$ can be reversed. As in pixel drive circuit 100, the first voltage is positive for normal operation of OLED light-emitting pixel 160. If the potential is reversed (e.g. power supply line 110 has a negative voltage relative to ground 150), OLED light-emitting pixel 160 will be in an inoperative condition and will function instead as a capacitor having a capacitance $C_{OLED}$. This potential, which is opposite in polarity to the first voltage, will herein be referred to as the second voltage. This will cause current to flow through drive transistor 210 in a second direction opposite to the above first direction. However, current flow in the second direction will only occur until the various capacitors in the circuit, including the OLED light-emitting pixel, become charged and cause the drive transistor to turn off. The use of this property of the pixel drive circuits described herein is an important feature of this invention, which will now be illustrated.

Figure 4A:
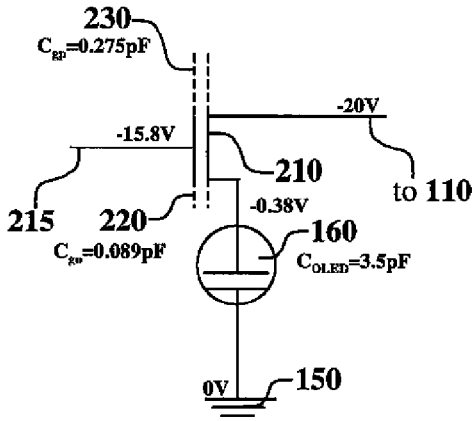
FIG. 4A through 4D show the stepwise results of the operations of this invention on a portion of an example pixel drive circuit.

Turning now to FIG. 4A through 4D, there are shown the stepwise results of the operations of this invention on a portion of an example pixel drive circuit 200. In preparation for FIG. 4A, a potential of zero volts is placed on power supply line 110 and on gate electrode 215. It is not required for the practice of this invention that power supply line 110 or gate electrode 215 first be set to zero volts; however, doing so will make illustration of the use of this invention clearer. The switch transistor that electrically connects gate electrode 215 to data line 120 is turned off, so that gate electrode 215 is isolated. Then a second voltage of −20V is applied to power supply line 110. With a second voltage, OLED light-emitting pixel 160 is in an inoperative condition and acts as a capacitor. In the example shown here, the OLED capacitance $C_{OLED}$ is 3.5 pF, the gate-OLED capacitance $C_{go}$ is 0.089 pF, and the gate-power capacitance $C_{gp}$ is 0.275 pF. The voltages shown in FIG. 4A are those expected with these capacitances before any current flows if the gate and power supply potentials are both initially zero. If either the gate or power supply potential—or both—is not zero, the resulting voltages will be different, but will still be a function of the capacitances.

Current will then flow through drive transistor 210 in a second direction, that is, electrons will flow from power line 110 to ground 150, and charge the $C_{OLED}$ capacitor. As the charge on $C_{OLED}$ is increased, the potential between the source and drain electrodes of drive transistor 210 is reduced. Simultaneously, the potential on the gate electrode of drive transistor 210 (which is isolated by switch transistor 180) will shift to maintain the ratio of the potential difference from the gate to source and drain in proportion to the inverse of the ratio of respective capacitances:

$$V_{gp}/V_{go}=C_{go}/C_{gp} \quad \text{(Eq. 1)}$$

Figure 4B:
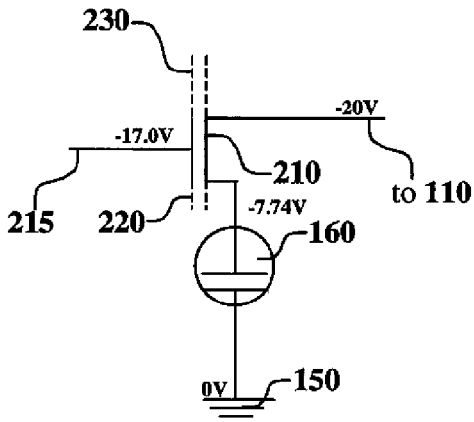

The current flow will continue until the potential $V_{go}$ between gate electrode 215 of drive transistor 210 and power supply line 110 falls to the value of the drive transistor threshold voltage, which causes the drive transistor to turn off. By turn off, it is meant that the current flow through drive transistor 210 is substantially zero. However, it is known in the art that transistors can leak small amounts of current under threshold voltage or lower conditions; such transistors can be successfully used in this invention. For illustration purposes, we are assuming in this example that the threshold voltage $V_{th}$ of drive transistor 210 is 3.0V. FIG. 4B shows the resulting voltages stored on the capacitors at this point. These voltages are a function of the threshold voltage of the transistor. Thus, the gate voltage is a threshold-voltage-proportional signal, and can be related to the threshold voltage by Eq. 2, wherein $PV_{DD2}$ represents the second voltage (e.g. −20V in this example) applied to power supply line 110:

$$V_{gate}=PV_{DD2}+V_{th} \quad \text{(Eq. 2)}$$

After the voltages have equilibrated as shown in FIG. 4*b*, select line 130 activates switch transistor 180 to connect gate electrode 215 to data line 120, wherein the gate electrode voltage will be changed by a transfer function, here represented by f(x). The transfer function depends on the characteristics of switch transistor 180, the change in potential of select line 130, the circuit layout, the capacitance and impedance of the external circuits connected to data line 120, and the number of pixels on data line 120 that are switched. One skilled in the art can predict the transfer function based on the design, or can measure it. Thus, the voltage produced on data line 120 ($V_{out}$) is a threshold-voltage-related signal which is a function of the potential on the gate electrode of the drive transistor, given by:

$$V_{out}=f(V_{gate}) \quad \text{(Eq. 3)}$$

The transfer function f(x) can be inverted, represented by $f^{-1}(x)$. The threshold voltage is calculated from the measured voltage by:

$$V_{th}=f^{-1}(V_{out})-PV_{DD2} \quad \text{(Eq. 4)}$$

Figure 4C:
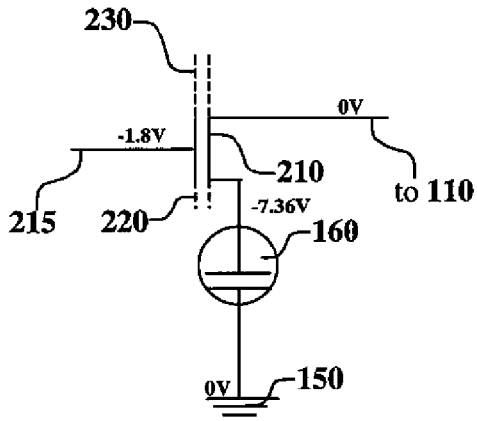
Figure 4D:
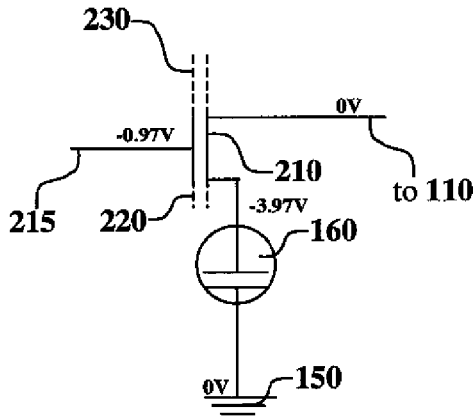

Alternatively, before activating switch transistor 180 and measuring the potentials, an additional step can be done wherein the potential of power supply line 110 can then be changed to a third voltage. This will redistribute the potentials based upon the capacitances, as shown in FIG. 4C. If the voltage is chosen correctly, such as zero in this example, current will flow through drive transistor 210 in the direction used to cause the OLED to emit light. No light will be emitted, as the OLED remains in a reverse bias condition. The current will continue to flow until the gate-to-OLED potential difference is equal to the threshold voltage of the drive transistor for current flow in the direction used for light emission. FIG. 4D shows the resulting voltages on the circuit at this point. The gate voltage can be related to the threshold voltage by:

$$V_{gate} = PV_{DD3} - \frac{V_{th}C_{gp}}{C_{go}} \quad \text{(Eq. 5)}$$

wherein $PV_{DD3}$ represents the third voltage (e.g. zero in this example) applied to power supply line 110. In this case the threshold voltage can be calculated from the measured voltage by:

$$V_{th} = \frac{-C_{go}(f^{-1}(V_{out}) - PVDD_3)}{C_{gp}} \quad \text{(Eq. 6)}$$

This last step of reducing the reverse driving potential (FIGS. 4C and 4D) is useful in the case that the threshold voltage of the driving transistor 210 is different for forward and reverse operation.

As the threshold voltage of a transistor can change with usage, it can be necessary to calculate an adjustment for the threshold voltage. This is the difference between the currently-calculated threshold voltage and the initial threshold voltage:

$$\text{Adjustment}=V_{th}-V_{thi} \quad \text{(Eq. 7)}$$

where $V_{thi}$ represents the initial threshold voltage of the transistor.

Figure 5A:
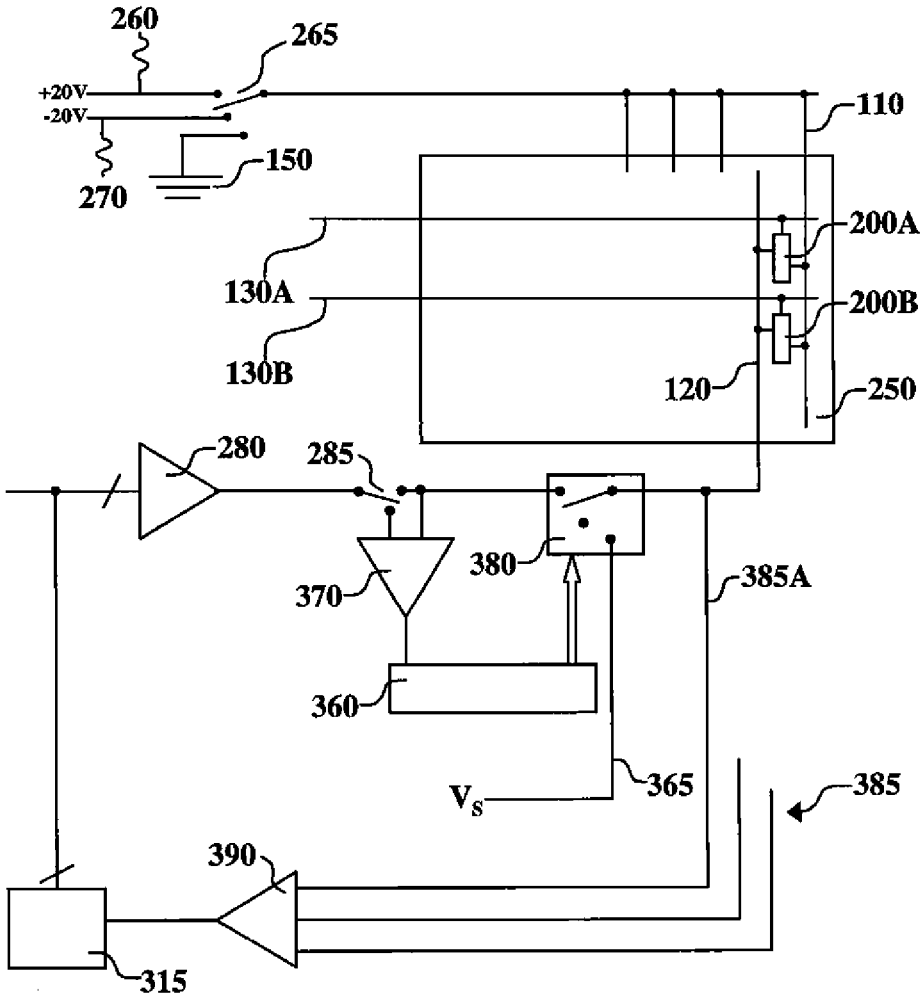
FIG. 5A shows a schematic diagram of one embodiment of a circuit according to this invention for determining an error-correcting voltage for compensating for changes in the threshold voltages for a drive transistor in a pixel drive circuit in an active matrix OLED display.

Turning now to FIG. 5A, and referring also to FIGS. 3 through 4D, there is shown a schematic diagram of one embodiment of an apparatus of this invention for selecting a stressing voltage for compensating for changes in the threshold voltages for drive transistors in pixel drive circuits as described herein. Active matrix OLED display 250 has a plurality of OLED light-emitting pixels arranged in an array, each having a pixel drive circuit as described above (e.g. 200A and 200B). In normal operation, voltage supply 260, which is a positive power supply, applies a first voltage (also called $PV_{DD1}$) to power supply line 110 via switch 265 to cause current to flow in a first direction through the drive transistors as described above, which causes OLED light-emitting pixels 160 to produce light. The intensity of the emitted light, which is proportional to the current through drive transistor 170, is responsive to the signal voltages set by data line 120, which is electrically connected to digital-to-analog converter 280. Digital-to-analog converter 280 converts a digital input representing the desired intensity of light emitted by a given pixel into an analog signal voltage, which a select line (e.g. 130A and 130B) allows to be written to the capacitors of the selected pixel circuit. Although not shown for clarity of illustration, it will be understood that OLED display 250 further includes multiple power supply lines and data lines, as known in the art.

In order to select a stressing voltage for compensating for changes in the threshold voltages ($V_{th}$) for the drive transistors of OLED display 250, it is necessary to apply a second voltage opposite in polarity to the first voltage to the power supply line and the pixel drive circuit and thus place the OLED in an inoperative condition, as described above. Voltage supply 270, which is a negative power supply in this embodiment, applies a second voltage ($PV_{DD2}$) opposite in polarity to the first voltage to power supply line 110 via switch 265. As described above, this causes current to flow through the drive transistor in a second direction opposite to the first direction of normal operation, until the potential on the gate electrode of the drive transistor causes the drive transistor to turn off. Switch 265 can also optionally switch the circuit to a third voltage state ($PV_{DD3}$), e.g. ground 150. During the second and third voltage operations, data line 120 can become an output line providing a threshold-voltage-related signal that is a function of the potential on gate electrode 215 of drive transistor 210. At another time during the process described herein, data line 120 is used to apply a stressing voltage to drive transistor 210, as will be described below. Switch 285 can be opened or closed as necessary.

In order to select the stressing voltage for individual drive transistors, one first obtains an average level of stress for the drive transistors of OLED display 250, and then compares the level of stress of individual drive transistors to the average. The term "level of stress" as used herein refers to changes in the threshold voltage of the drive transistor. Integrator line 385A connects data line 120 to integrator 390. To obtain an average level of stress after the voltages in the pixel drive circuits have equilibrated as described above in FIG. 4B or 4D, all select lines for all rows (e.g. 130A, 130B) are activated, turning on switch transistors 180 and opening data line 120 to gate electrodes 215 of all pixels in that column. The voltage then produced on data line 120 is a threshold-voltage-related signal that is an average of the threshold-voltage-related signals that would be provided by the individual pixels in the column. Data line 120 is connected via integrator line 385A to integrator 390. Other data lines for other columns of pixels (not shown) are also connected to integrator 390 via their corresponding integrator lines 385. Each data line thus has a threshold-voltage-related signal that is an average for the column. Integrator 390 is responsive to the plurality of threshold-voltage-related signals to produce an average threshold-voltage-related signal Vout for all pixels of OLED display 250. The average threshold-voltage-related signal is relayed to processor 315, which can calculate (via Eq. 4 or Eq. 6) the average threshold voltage or simply store the average threshold-voltage-related signal.

In the present embodiment, the target value of the threshold-voltage-related signal is based on the current average threshold voltage of the display. Other embodiments are possible, such as use of the initial value of the average threshold voltage of the display.

Once the average threshold voltage is known, the stressing voltage can be selected and applied on a row-by-row basis based on the threshold-voltage-related signal from each pixel. The process shown in FIG. 4 is repeated for each row of pixels in OLED display 250. Switch 285 is set to connect the output of digital-to-analog converter 280 to one input of voltage comparator circuit 370, and processor 315 causes digital-to-analog converter 280 to produce a voltage equal to the average threshold-voltage-related signal. One select line (e.g. 130A) is activated, turning on switch transistor 180 and opening data line 120 to a single pixel (e.g. 200A) in its column. The voltage then produced on data line 120 is a threshold-voltage-related signal for a single pixel, and the signal is delivered to a second input of voltage comparator circuit 370. Voltage comparator circuit 370 is responsive to the threshold-voltage-related signal and the average threshold-voltage-related signal. Its output can be positive or negative and goes to sample-and-hold element 360 and then to voltage selector switch 380, which selects the stressing voltage and selectively applies it to the gate electrode of the selected drive transistor. In this embodiment, voltage selector switch 380 is provided with a single stressing voltage Vs from stressing voltage source 365, which voltage selector switch 380 selects to apply or not apply based on the threshold-voltage-related signal. For example, the voltage from stressing voltage source 365 can be +15V. If the threshold-voltage-related signal of a pixel is less than the average, which indicates that the pixel is less stressed than average, voltage selector switch 380 can select to apply the stressing voltage to the pixel. If the threshold-voltage-related signal is greater than or equal to the average, voltage selector switch 380 can instead select a neutral or disconnected position, and thus not apply the stressing voltage.

After the stressing voltage is applied, processor 315 can provide an adjustment to the signal voltage applied to the gate electrodes of the drive transistors. This adjustment can be accomplished by shifting the analog reference voltage for the signal digital-to-analog converter 280. Because the practice of this invention reduces the threshold voltage range in the drive transistors, the shift applied to the signal voltages in order to compensate for the shift in the threshold voltage of the drive transistors can be the same for all drive transistors.

Figure 5B:
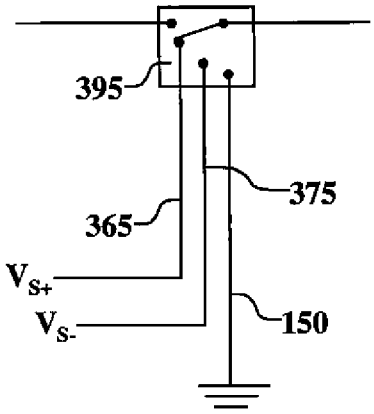
FIG. 5B shows a portion of another embodiment of the above circuit.

Turning now to FIG. 5B, there is shown another embodiment of a portion of the apparatus of FIG. 5A wherein one of a plurality of stressing voltages can be selected to be applied based on the threshold-voltage-related signal. In this embodiment, voltage selector switch 395 is provided with three stressing voltages: a positive stressing voltage $V_{s+}$ from stressing voltage source 365, a negative stressing voltage $V_{s-}$ from stressing voltage source 375, and a zero voltage from ground 150. For example, if the threshold-voltage-related signal of a pixel is significantly less than the average, which indicates that the pixel is less stressed than average, voltage selector switch 380 can select to apply stressing voltage $V_{s+}$ to the pixel. If the threshold-voltage-related signal is significantly greater than the average, voltage selector switch 380 can select to apply stressing voltage $V_{s-}$ to the pixel, and thus reduce the stress level of the drive transistor. If the threshold-voltage-related signal is approximately average, voltage selector switch 380 can select to apply the zero voltage to the pixel.

Figure 6:
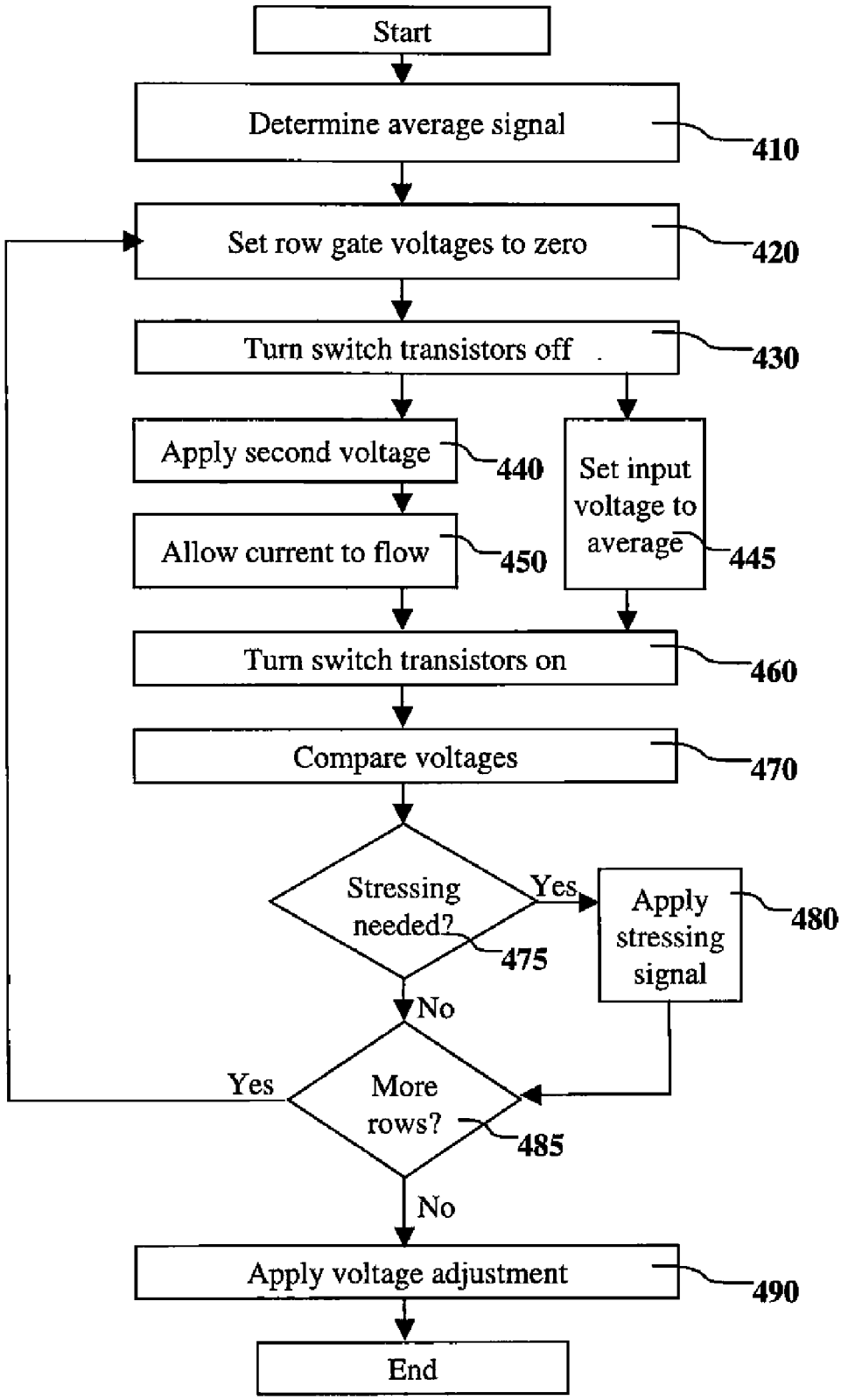
FIG. 6 shows a block diagram of one embodiment of a method according to this invention for determining an error-correcting voltage for compensating for changes in the threshold voltages for a drive transistor in a pixel drive circuit in an active matrix OLED display.

Turning now to FIG. 6, and referring also to FIGS. 3 through 5A, there is shown a block diagram of one embodiment of a method using the apparatus of this invention for selecting a stressing voltage for compensating for changes in the threshold voltages for drive transistors in pixel drive circuits in an active matrix OLED display, and for applying the stressing voltage to the pixels. At the start, an average threshold-voltage-related signal is determined for the entire OLED display 250 (Step 410). Step 410 will be described in greater detail below. Then, the gate voltages of an entire row are set to zero by setting all data lines 120 to zero and turning on switch transistors 180 by selecting the appropriate select line 130 (Step 420). Switch transistors 180 are then turned off (Step 430). Then a second voltage opposite in polarity to the first driving voltage is applied to OLED light-emitting pixel 160 by connecting negative voltage supply 270 to power supply line 110 via switch 265 (Step 440), thus placing the OLED in an inoperative condition. Then current is allowed to flow through the circuit (Step 450) to charge the capacitors: OLED 160, gate-OLED capacitor 220, and gate-power capacitor 230. Current flows until the voltage difference between gate electrode 215 and power supply line 110 equals the threshold voltage of drive transistor 210, which causes the drive transistor to turn off. The resulting voltages are as shown in FIG. 4B. Additionally, a third voltage can be applied, which would result in the voltages shown in FIG. 4D. During the time between Steps 430 and 460, switch 285 connects digital-to-analog converter 280 with voltage comparator circuit 370, and digital-to-analog converter 280 is caused to input the average threshold-voltage-related signal to voltage comparator circuit 370 (Step 445). Then switch transistors 180 are turned on for the row of pixel drive circuits 200 by selecting the appropriate select line 130 (Step 460). Voltage comparator circuit 370 compares the threshold-voltage-related signal with the average (Step 470), and thus indirectly measures the voltages stored on the capacitors of the pixel drive circuit, which will show whether the drive transistor 210 is stressed more or less than the average. If voltage comparator circuit 370 indicates that the drive transistor is stressed less than average (Step 475), voltage selector switch 380 can apply a stressing voltage to drive transistor 210 for a predetermined period (Step 480). Otherwise, Step 480 is skipped. If there are more rows of pixel drive circuits 200 in OLED display 250 (Step 485), the process is repeated. If there are no more rows of pixel circuits, the stressing process is complete. Processor 315 can provide an adjustment to the signal voltage to the gate electrodes of drive transistors 210 to compensate for changes in the average threshold voltage (Step 490). Step 490 need not follow immediately after Step 485. For example, Steps 410 to 485 can be done sequentially to all rows of pixel drive circuits 200 upon power-down of OLED display 250. Step 490 can then be done to the display the next time it is powered on.

Figure 7A:
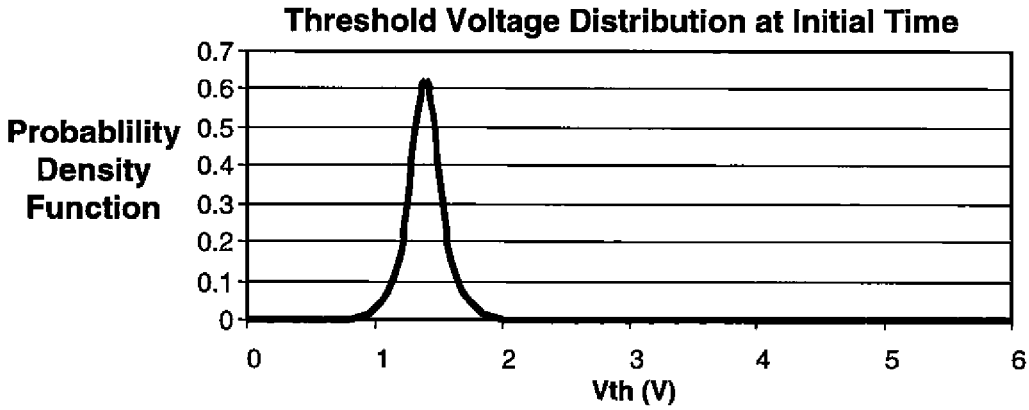
FIG. 7A through 7C show the distribution of threshold voltages at different times of a display's lifetime, before and after the application of this invention.
Figure 7B:
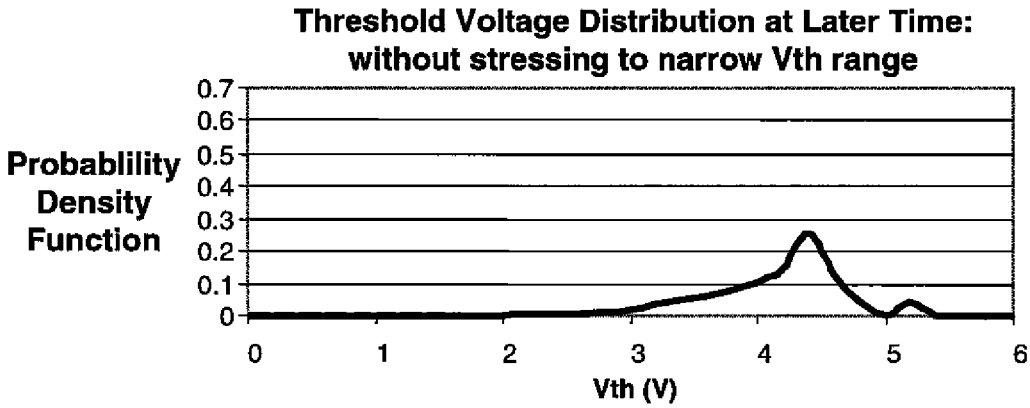
Figure 7C:
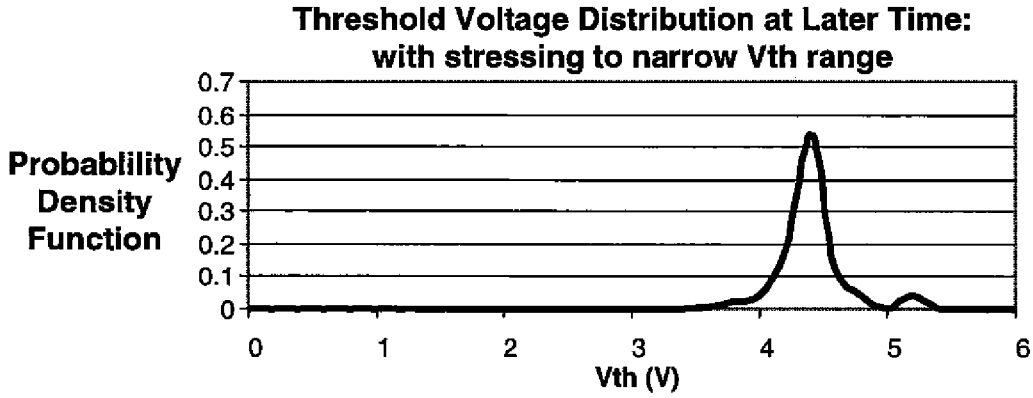

Turning now to FIG. 7A, there is shown an initial distribution of threshold voltages of drive transistors in an OLED display, wherein the vertical axis represents the fraction of pixel drive circuits with a given threshold voltage. Turning now to FIG. 7B, there is shown a distribution of the threshold voltages in the same display as FIG. 7A, but after it has been operated for a time. The drive transistors now have higher threshold voltages than initially. Further, the threshold voltage range is broader, which makes it difficult to apply a single adjustment to the signal voltage to the entire display to compensate for the threshold voltage change. Some transistors will be overcompensated, while others will be undercompensated by a single adjustment. Turning now to FIG. 7C, there is shown a distribution of threshold voltages in the display of FIG. 7B after the use of this invention. A compensating stress signal, e.g. a voltage of 10-15 volts, has been applied to the pixels of FIG. 7B with a lower-than-average threshold voltage. This has increased their threshold voltages to average or slightly greater. The overall effect is to reduce the threshold voltage range in the drive transistors based on the threshold-voltage-related signals, which makes it easier to apply a single adjustment to the signal voltage to compensate for threshold voltage changes wherein the adjustment is the same for all drive transistors.

Other embodiments are possible. For example, instead of applying a positive voltage stress to drive transistors with less-than-average threshold voltages, one can apply a negative voltage stress to drive transistors with greater-than-average threshold voltages. Thus, the distribution of threshold voltages in FIG. 7B can be narrowed by lowering the threshold voltages of the more stressed drive transistors. In the embodiment of FIG. 5B, voltage selector 380 can have three inputs: zero voltage, large positive (e.g. +15V), and large negative (e.g. −15V). The large positive voltage can be applied to drive transistors with a less-than-average threshold voltage, while the large negative voltage can be applied to drive transistors with a greater-than-average threshold voltage. The zero voltage can be applied to drive transistors that have an average or near-average threshold voltage. Thus, the distribution of threshold voltages in FIG. 7B can be narrowed from both sides.

Figure 8:
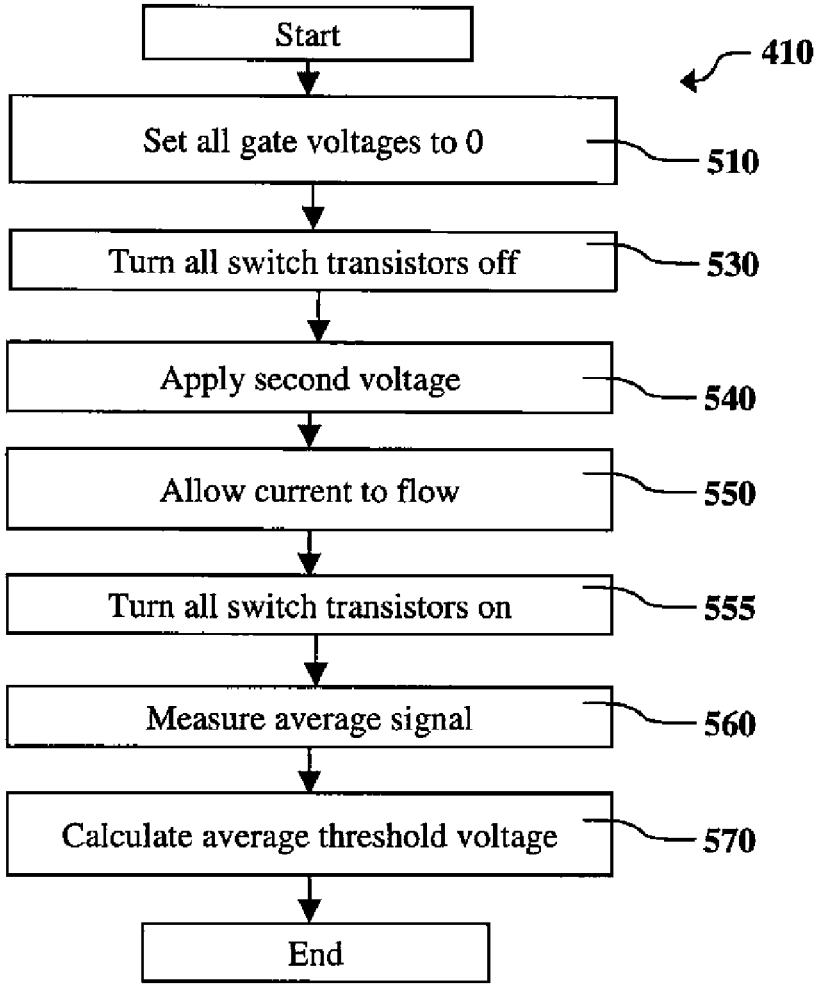
FIG. 8 shows a block diagram of one embodiment of a method for determining an average threshold voltage for a display.

Turning now to FIG. 8, and referring also to FIGS. 3 through 5A, there is shown a block diagram of one embodiment of a method for determining an average threshold-voltage-related signal for the display. At the start, the gate voltages of the entire display are set to zero by setting all data lines 120 to zero volts and turning on switch transistors 180 for all pixel drive circuits (e.g. 200A, 200B, etc.) by selecting all select lines (e.g. 130A, 130B, etc.) (Step 510). Then all switch transistors 180 are turned off (Step 530). A second voltage opposite in polarity to the first driving voltage is applied to all OLED light-emitting pixels 160 by connecting negative voltage supply 270 to power supply line 110 via switch 265 (Step 540), thus placing the OLEDs in an inoperative condition. Then current is allowed to flow through the circuit (Step 550). In this case, current will flow to charge the capacitors: OLEDs 160, gate-OLED capacitors 220, and gate-power capacitors 230. Current flows until the voltage difference across gate-power capacitor 230 equals the threshold voltage of its particular drive transistor 210, as shown in FIG. 4B, which causes the drive transistors to turn off. A third voltage can also be used, as described above, to obtain a threshold-voltage-related signal for current flow in the OLED-on direction, as shown in FIG. 4D. All switch transistors 180 are turned on for all pixel drive circuits by selecting all select lines (Step 555). The average threshold-voltage-related signal can then be produced by integrator 390 and measured by processor 315 (Step 560). Since the data lines 120 of all pixel drive circuits are connected to processor 315 by integrator 390, the gate-source voltage read is an average for the entire display. The average threshold voltage Vth is related to the average threshold-voltage-related signal as described above. Processor 315 can calculate or find the average threshold voltage of drive transistors 210 in all pixel drive circuits (Step 570). This value can then be used in determining the relative stress levels of the drive transistors in order to select a stressing voltage, as described above. In particular, one can use Eq. 3 to calculate the average threshold-voltage-related signal expected for a single pixel. Alternatively, the average threshold-voltage-related signal measured in Step 560 can be used directly for the process described above in FIG. 6.

Figure 9:
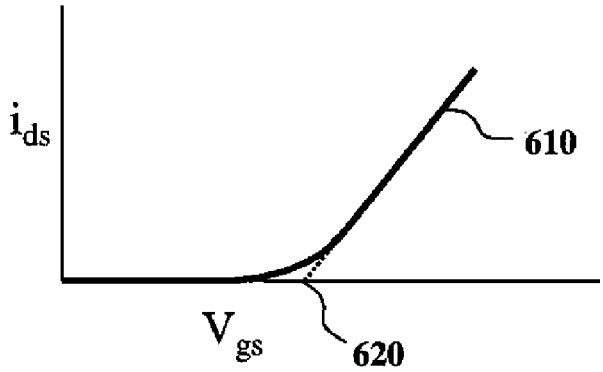
FIG. 9 shows a graph of current vs. voltage in another embodiment of a method for determining an average threshold voltage for a display.

Other methods of obtaining an average threshold voltage, which will be apparent to those skilled in the art, can be used with this invention. For example, a threshold voltage can be determined for drive transistor 210 of each pixel drive circuit, and a numerical average calculated. A method for determining the threshold voltages for each of the drive transistors is taught by Hamer et al. U.S. Ser. No. 11/427,104 (Publication No. 2008/0001854. Alternatively, as shown in FIG. 9, the current ($i_{ds}$) for the entire display can be measured while varying the gate voltage ($V_{gs}$) at a constant drive voltage ($PV_{DD}$–CV). This can produce curve 610, which can be extrapolated to average threshold voltage 620.

The invention has been described in detail with particular reference to certain preferred embodiments thereof, but it will be understood that variations and modifications can be effected within the spirit and scope of the invention.

| | |
|---|---|
| 100 | pixel drive circuit |
| 105 | pixel drive circuit |
| 110 | power supply line |
| 120 | data line |
| 130 | select line |
| 130A | select line |
| 130B | select line |
| 140 | OLED light-emitting pixel |
| 145 | drain electrode |
| 150 | ground |
| 155 | source electrode |
| 160 | OLED light-emitting pixel |
| 165 | gate electrode |
| 170 | drive transistor |
| 180 | switch transistor |
| 185 | source or drain electrode |
| 190 | capacitor |
| 195 | gate electrode |
| 200 | pixel drive circuit |
| 200A | pixel drive circuit |
| 200B | pixel drive circuit |
| 210 | drive transistor |
| 215 | gate electrode |
| 220 | capacitor |
| 230 | capacitor |
| 250 | OLED display |
| 260 | voltage supply |
| 265 | switch |
| 270 | voltage supply |
| 280 | digital-to-analog converter |
| 285 | switch |
| 315 | processor |
| 360 | sample-and-hold element |
| 365 | stressing voltage source |
| 370 | voltage comparator circuit |
| 375 | stressing voltage source |
| 380 | voltage selector switch |
| 385 | integrator lines |
| 385A | integrator line |
| 390 | integrator |
| 395 | voltage selector switch |
| 410 | block |
| 420 | block |
| 430 | block |
| 440 | block |
| 445 | block |
| 450 | block |
| 460 | block |
| 470 | block |
| 475 | decision block |
| 480 | block |
| 485 | decision block |
| 490 | block |
| 510 | block |
| 530 | block |
| 540 | block |
| 550 | block |
| 555 | block |
| 560 | block |
| 570 | block |
| 610 | curve |
| 620 | threshold voltage |

What is claimed is:

1. An apparatus for increasing or lowering the threshold voltages of drive transistors in pixel drive circuits in an active matrix OLED display to reduce a threshold voltage (Vth) range of the drive transistors, comprising:

a) the active matrix OLED display having a plurality of OLED light-emitting pixels arranged in an array, each having a corresponding pixel drive circuit;

b) each pixel drive circuit being electrically connected to a data line and a power supply line, and having two transistors, a drive transistor and a switch transistor, the drive transistor having source, drain, and gate electrodes, and the switch transistor having source, drain, and gate electrodes, wherein each drive transistor has a respective threshold voltage;

c) the source or drain electrode of each drive transistor being electrically connected to its corresponding power supply line, and the other of the source or drain electrode being electrically connected to its corresponding OLED light-emitting pixel;

d) the source or the drain electrode of each switch transistor being electrically connected to the gate electrode of its corresponding drive transistor, and the other of the source or drain electrode being electrically connected to its corresponding data line;

e) first means for applying a first voltage to the power supply lines which is either positive or negative for causing current to flow in a first direction through the drive transistors which causes the OLED light-emitting pixels to produce light in response to the signal voltages;

f) second means for applying a second voltage to the power supply lines opposite in polarity to the first voltage so that current will flow through the drive transistors in a second direction opposite to the first direction until the potential on the gate electrodes of the drive transistors causes the drive transistors to turn off;

g) third means for producing a plurality of threshold-voltage-related signals on the data lines, each of which is a function of the corresponding potentials on the gate electrodes of the corresponding drive transistors;

h) fourth means responsive to the plurality of threshold-voltage-related signals for producing a target value of the threshold-voltage-related signal for the entire display; and i) fifth means responsive to the target value of the threshold-voltage-related signal for selectively applying a selected stressing voltage to the gate electrodes of selected drive transistors based on their respective threshold-voltage-related signals to increase or lower the threshold voltages of the selected drive transistors to reduce a threshold voltage range of the drive transistors.

2. The apparatus of claim 1 wherein the OLED light-emitting pixels are non-inverted OLED pixels and the first voltage is positive relative to a ground value.

3. The apparatus of claim 1 wherein the OLED light-emitting pixels are inverted OLED pixels and the first voltage is negative relative to a ground value.

4. The apparatus of claim 1 wherein the drive transistors and switch transistors are n-type transistors.

5. The apparatus of claim 1 wherein the drive transistors and switch transistors are p-type transistors.

6. The apparatus of claim 1 wherein a single stressing voltage is selected to be applied or not applied to a selected drive transistor based on the corresponding threshold-voltage-related signal.

7. The apparatus of claim 1 wherein one of a plurality of stressing voltages is selected to be applied to a selected drive transistor based on the corresponding threshold-voltage-related signal.

8. The apparatus of claim 1 wherein the stressing voltage is applied on a row-by-row basis for each row in the display.

9. The apparatus of claim 1, further including sixth means responsive to the threshold-voltage-related signal for selecting the stressing voltage.

10. The apparatus of claim 1, wherein the target value of the threshold-voltage-related signal is an average threshold-voltage-related signal.

* * * * *